United States Patent [19]

Lin

[11] Patent Number: 4,905,830

[45] Date of Patent: Mar. 6, 1990

[54] PACKING CASE ALSO USABLE FOR CLOTHES-HANGING AND DRAWING PURPOSES

[76] Inventor: Yen-Hui Lin, No. 6, Lane 55, Tao-Yuan St., Tao-Yuan Li, Changhua City, Taiwan

[21] Appl. No.: 388,825

[22] Filed: Aug. 3, 1989

[51] Int. Cl.[4] ..... B65D 6/18

[52] U.S. Cl. ..... 206/362.2; 206/371; 206/214; 206/224; 206/806; 220/4 B; 33/558.01

[58] Field of Search ..... 206/361, 371, 362.2, 206/362.1, 38, 214, 224, 234, 278, 288, 806; 220/4 B, 324, 315, 94; 223/88, 89, 85; 33/558.01, 27.02

[56] References Cited

U.S. PATENT DOCUMENTS

| | | | |
|---|---|---|---|
| 128,417 | 6/1872 | Nicol | 33/558.01 |
| 1,998,352 | 4/1935 | Bachmann | 33/558.01 |
| 2,868,361 | 1/1959 | Zilem et al. | 206/362.2 |
| 3,124,399 | 3/1964 | Seta | 206/362.2 |
| 3,239,093 | 3/1966 | Gath | 220/4 B |
| 3,963,154 | 6/1976 | Schwartz et al. | 223/88 |
| 4,795,048 | 1/1989 | Trussardi | 220/4 B |

*Primary Examiner*—Stephen Marcus
*Assistant Examiner*—Jacob K. Ackun, Jr.
*Attorney, Agent, or Firm*—Irving M. Weiner; Robert M. Petrik; Joseph P. Carrier

[57] ABSTRACT

A packing case includes a case body consisting of an upper housing and a lower housing between which a chamber is formed. An end of the upper housing is connected pivotally to an end of the lower housing by a pivot coupler. The pivot coupler clamps the ends of the housings resiliently together. A needle and a lead core can be secured to the non-pivoted ends of the housings so that the packing case functions as a pair of compasses for drafting purposes. When the non-pivoted ends of the housings are separated, the relative position of the housings or compasses are fixed accordingly. When the housings are bifurcated, a swivel hook can be journalled on the pivot coupler so as to constitute a clothes hanger.

9 Claims, 8 Drawing Sheets

PACKING CASE ALSO USABLE FOR CLOTHES-HANGING AND DRAWING PURPOSES

BACKGROUND OF THE INVENTION

This invention relates to a packing case, more particularly to a packing case which can be used for hanging and drawing.

Conventional packing cases (e.g. toothbrush cases and pencil cases) can only accommodate certain articles therein. However, when a person does not wish to pack the particular items into the cases which were designed to hold, the packing cases are useless. From an economical standpoint, it is desirable to expand the applications of such packing cases.

SUMMARY OF THE INVENTION

It is the main object of this invention to provide a packing case which can be adjusted into a clothes hanger or an auxiliary drawing instrument.

According to this invention, a packing case includes a case body consisting of an upper housing and a lower housing between which a chamber is formed. An end of the upper housing is connected pivotally to an end of the lower housing by a pivot coupler. The pivot coupler clamps the ends of the housings resiliently together. A needle and a lead rod can be secured to the non-pivoted ends of the housings so that the packing case functions as a pair of compasses for describing circles. When the non-pivoted ends of the housings are separated, the relative position of the housings or compasses can be fixed accordingly. When the housings are bifurcated, a swivel hook can be journalled on the pivot coupler so as to constitute a clothes hanger.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
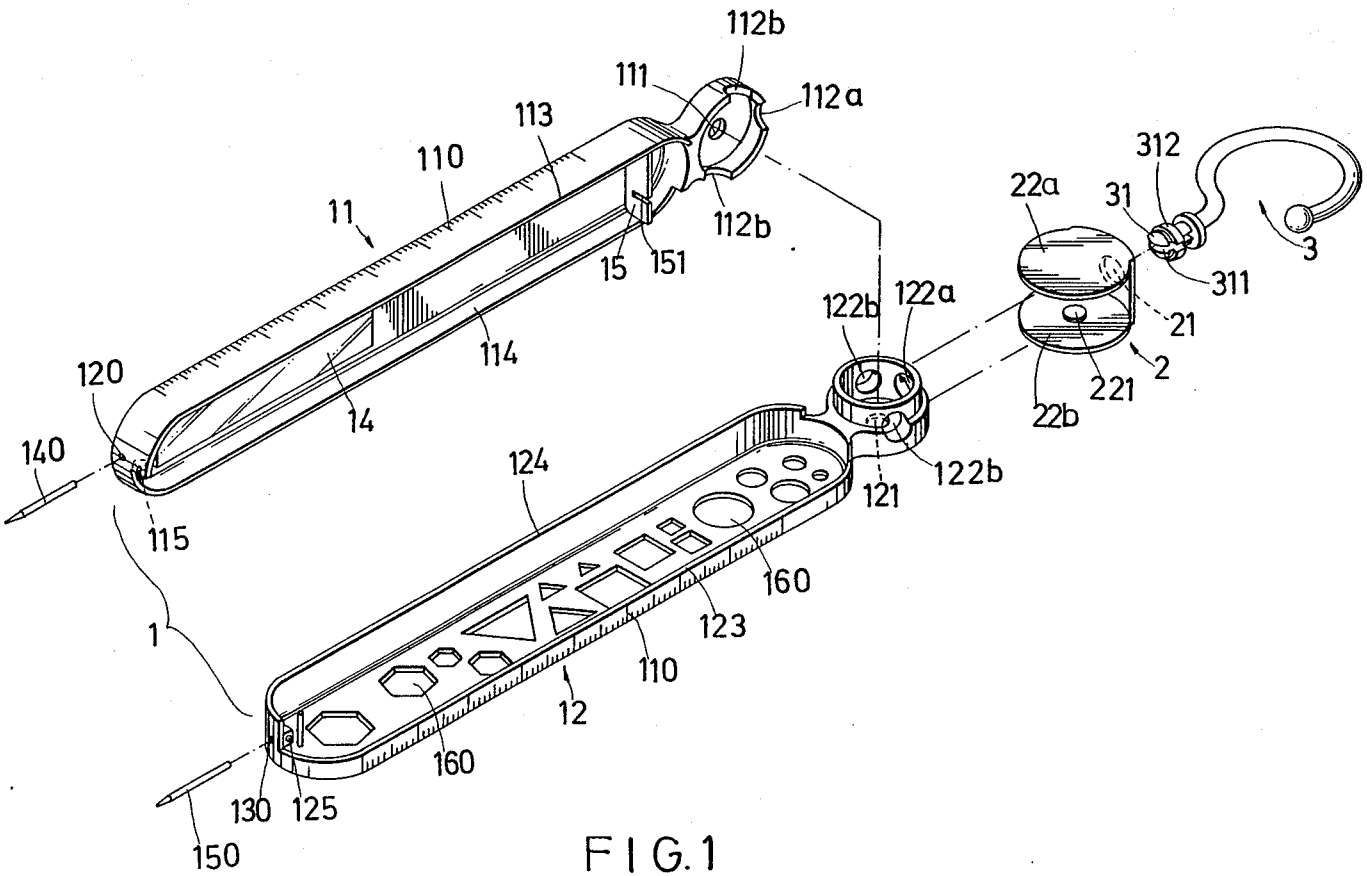
FIG. 1 is an exploded view of a packing case according to this invention.
Figure 2:
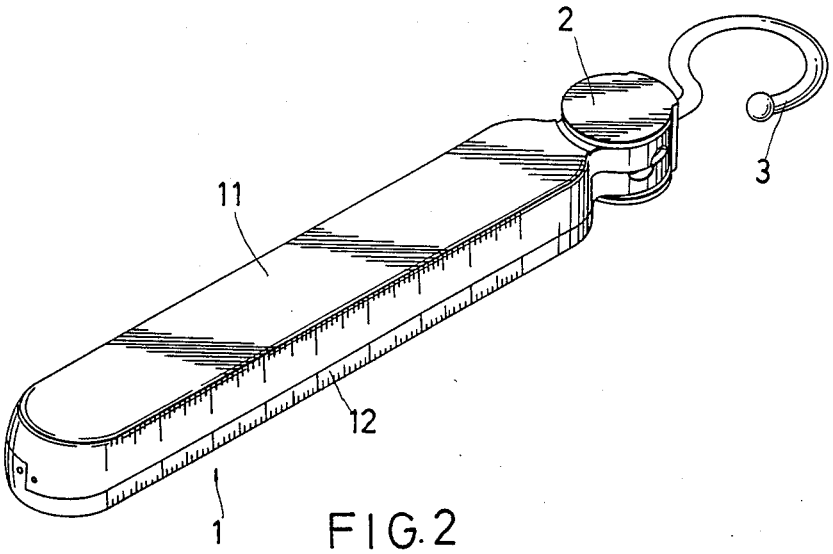
FIG. 2 is an assembled view showing the packing case of this invention.

Referring to FIGS. 1 and 2, a packing case of this invention includes an elongated plastic case body 1 consisting of an upper housing 11 and a lower housing 12, a generally U-shaped plastic pivot coupler 2, and a plastic swivel hook 3.

A hollow upper cylinder is integrally formed with the right end of the upper housing 11 and includes a horizontal top wall having a central hole 111 formed therethrough, and a circumferential vertical wall having an end notch 112*a* and two diametrically opposed positioning notches 112*b* formed on two sides of the end notch 112*a*. A hollow lower cylinder is integrally formed with the right end of the lower housing 12 and includes a horizontal bottom wall having a central hole 121 formed therethrough, and a circumferential vertical wall having an end hole 122*a* formed therethrough in alignment with the end notch 112*a*, and two diametrically opposed positioning holes 122*b* formed on two sides of the end hole 122*a*.

The upper housing 11 has a high side wall 113 and a low side wall 114. The lower housing 12 has a low side wall 123 abutting against the high side wall 113 of the upper housing 11, and a high side wall 124 abutting against the low side wall 114 of the upper housing 11. As illustrated, the lower cylinder has a diameter-reduced upper portion on which the upper cylinder is sleeved rotatably. The coupler 2 includes a rectangular vertical plate having a retaining hole 21 formed therethrough, and two generally circular horizontal plates 22*a*, 22*b* with pivot posts 221 extending from the centers of the inner surfaces thereof and through the central holes 111, 121 of the cylinders 11, 12, so as to pivotally interconnect the housings 11, 12. The upper horizontal plate 22*a* extends somewhat downward from the vertical plate, while the lower horizontal plate 22*b* extends somewhat upward from the vertical plate, so that the cylinders are clamped tightly between the horizontal plates 22*a*, 22*b* of the coupler 2. The lower housing 12 includes a tongue 125 provided on the non-pivoted end portion thereof which is engaged with the groove 115 in the non-pivoted end portion of the upper housing 11 so as to interlock the non-pivoted ends of the housings 11, 12.

The swivel hook 3 has a curved hanging portion and a coupling portion 31 which is inserted through the retaining hole 21 of the coupler 2. The coupling portion 31 has an open-ended slot 311 formed in the end surface thereof defining two easily bendable portions on two sides of the slot 311, and an annular groove 312 formed in the circumferential surface of the coupling portion 31 so as to engage with the vertical plate of the coupler 2 which defines the retaining hole 21. When the bendable portions of the coupling portion 31 are pressed together, it is easy to move the end of the coupling portion 31 through the retaining hole 21 of the coupler 2.

Figure 2A:
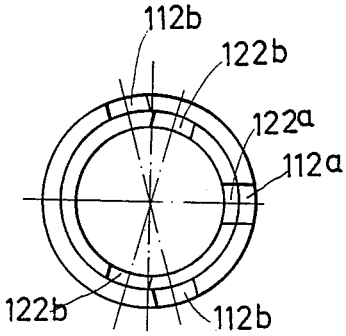
FIG. 2A is a schematic view illustrating the relative locations of the positioning holes and the positioning notches of the packing case according to this invention.
Figure 3:
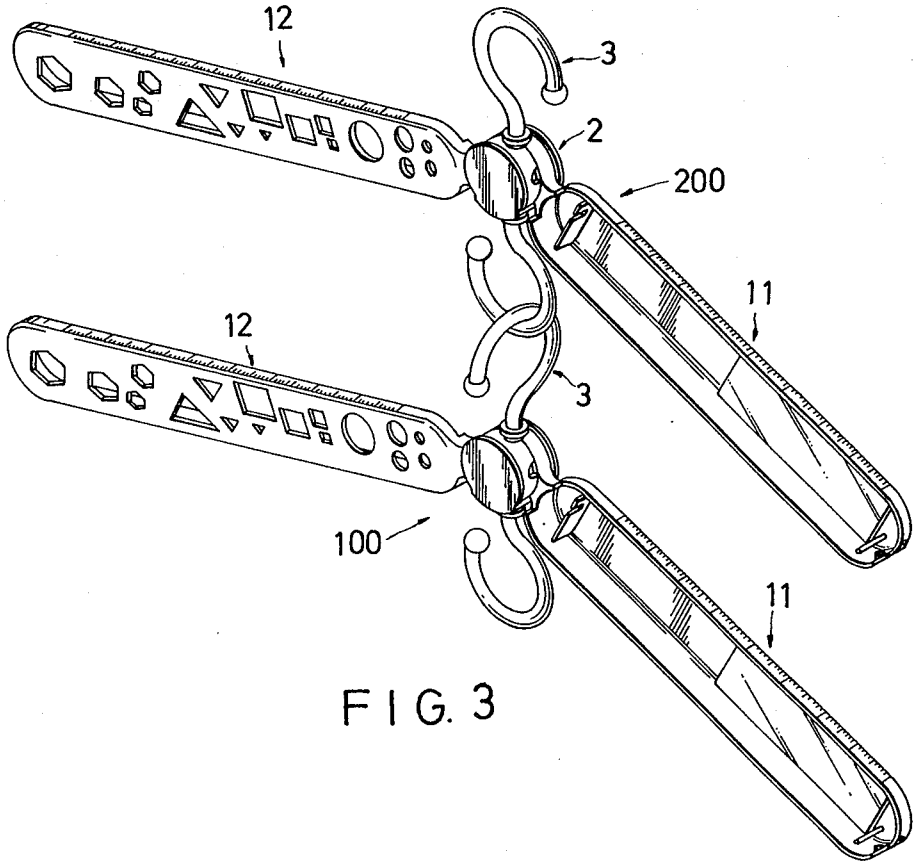
FIG. 3 is a schematic view illustrating how to use packing cases according to this invention as clothes hangers which are interconnected in series.

Referring to FIG. 2A, the positioning notches 112*b* are in two horizontal positions which are angularly symmetrical to those of the positionihg holes 122*b* Accordingly, when the swivel hook 3 is removed from the coupler 2 and the non-pivoted ends of the housings 11, 12 are pulled outward to the positions shown in FIG. 3 so as to align the positioning notches 112*b* with the positioning holes 122*b*, two swivel hooks 3 can be inserted through the positioning notches 112 and the positioning holes 122*b*. One case body 1, one coupler 2 and two swivel hooks 3 thus constitute a hanging unit. In this way, a plurality of hanging units can be formed. Then, as illustrated, the upper swivel hook 3 of a lower hanging unit 100 can be hung on the lower swivel hook 3 of an upper hanging unit 200.

Figure 4:
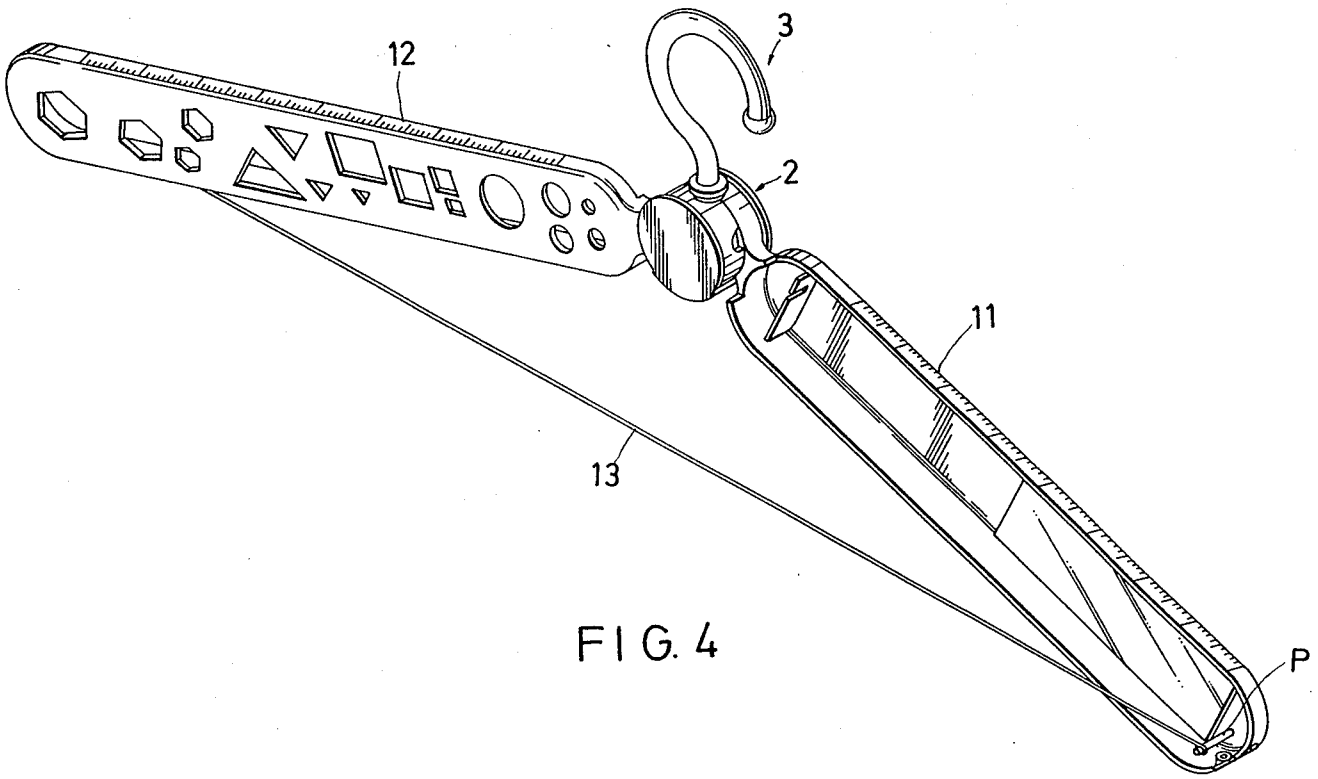
FIG. 4 is a schematic view illustrating how to incorporate a nylon thread in the packing case so as to form the horizontal strand of a clothes hanger in accordance with this invention.

Each of the housings 11, 12 includes a retaining post (P) provided on the non-pivoted end portion thereof. As shown in FIG. 4, in a situation where the packing case is in the form of a clothes hanger which has two inclined strands, a nylon thread 4 can be tied to the retaining posts (P) of the housings 11, 12 at two ends thereof so as to form the horizontal strand of the clothes hanger.

Figure 5:
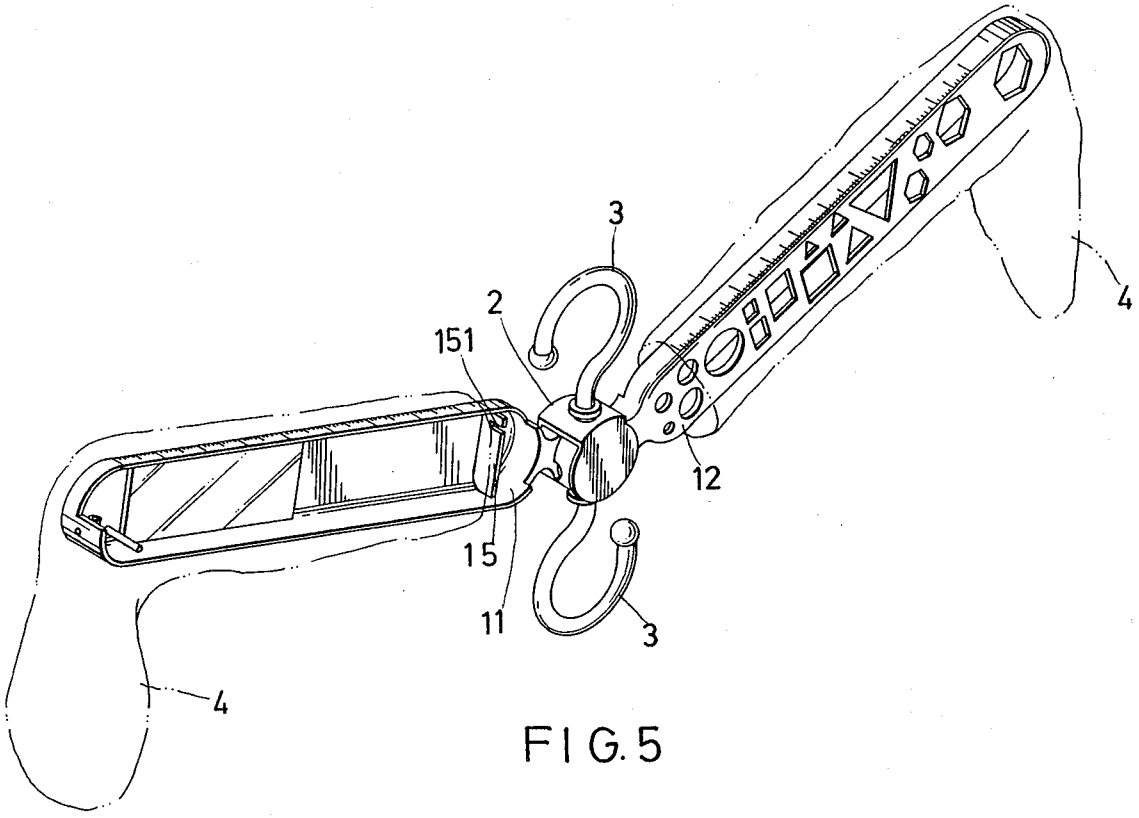
FIG. 5 is a schematic view illustrating how to hang stockings on the clothes hanger which is formed from the packing case of this invention.

Referring to FIG. 5, when the hanging unit 100, 200 of FIG. 3 is in a position where the non-pivoted ends of the housings 11, 12 are higher than the pivoted ends of the same, stockings 4, or the like, can be sleeved on the non-pivoted ends of the housings 11, 12.

Figure 6:
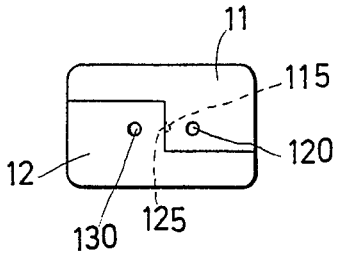
FIGS. 6 and 7 are schematic end views illustrating two modified forms of the tongue and groove joint which interlocks the housings of the packing case in accordance with this invention.
Figure 7:
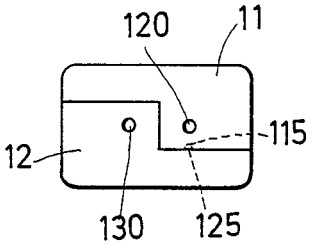

FIGS. 6 and 7 are end views of the housings 11, 12. As illustrated, the positions of the tongue 125 and the groove 115 can be moved to the vertical or horizontal surfaces of the end walls of the housings 11, 12.

Figure 1A:
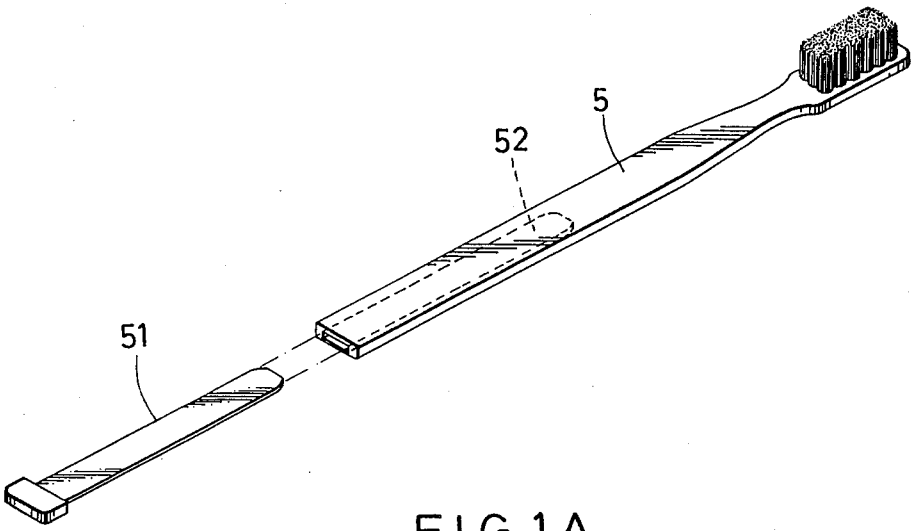
FIG. 1A is a partially exploded view showing a toothbrush which may be retained within the packing case of this invention.

Again referring to FIG. 1, the top wall of the upper housing 11 includes a mirror 14 attached to the bottom surface thereof, and a downward extending fastening plate 15 having a retaining slit 151. When a toothbrush 5 (see FIG. 1A) is stored within the case body 1, a tongue-cleaning stick 51, which is accommodated within the slot 52 of the toothbrush 5, can be inserted into the retaining slit 151 so as to retain the toothbrush 5 within the case body 1.

Figure 8:
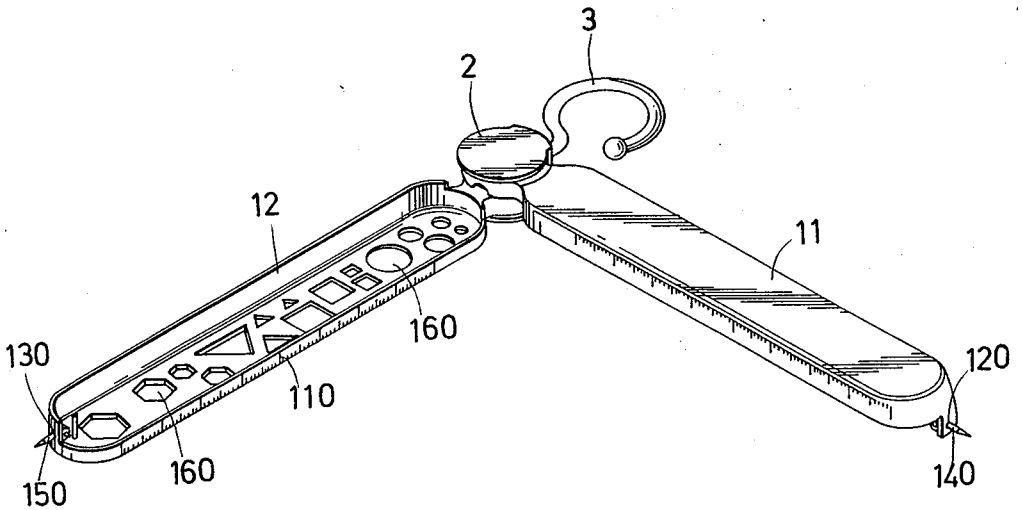
FIG. 8 is a perspective view showing a form of the packing case which acts as a pair of drafting compasses.

To use as an auxiliary drawing instrument, each of the housings 11, 12 has a cylindrical cavity 120, 130 formed in the non-pivoted end surface thereof. A needle 140 and a lead rod 150 are respectively inserted into the cavities 120, 130 so that the packing case can form a pair of drafting compasses. Referring to FIG. 8, when the non-pivoted ends of the housings 11, 12 are separated, the relative position of housings 11, 12 are fixed due to the fact that the pivoted ends of the housings 11, 12 are clamped between the horizontal plates 22 of the coupler 2. Scales 110 are indicated on both the high side wall 113 of the upper housing 11 and the low side wall 123 of the lower housing 12. Several circular, triangular, square and hexagonal holes 160 of different sizes are formed through the bottom wall of the lower housing 12.

With this invention thus explained, it is apparent that numerous modifications and variations can be made without departing from the scope and spirit of this invention. It is therefore intended that this invention be limited only as indicated in the appended claims.

I claim:

1. A packing case comprising:

a plastic case body including an elongated lower housing which has an open top side, and an elongated upper housing which has an open bottom side and seals said top side of said lower housing, said upper and lower housings together defining a chamber therebetween, said lower housing including a hollow lower cylinder secured to an end thereof at a side of said lower cylinder, said lower cylinder having a generally circular bottom wall, a vertical wall extending upward from a circumference of said bottom wall, an end hole formed through an opposite side of said lower cylinder, and two diametrically opposed positioning holes formed through said vertical wall on two sides of said end hole, said upper housing including a hollow upper cylinder secured to an end thereof at a side of said upper cylinder, said upper cylinder having a generally circular top wall, a vertical wall extending downward from a circumference of said top wall to enclose said vertical wall of said lower cylinder, an end notch formed in a lower side of said vertical wall of said upper cylinder in alignment with said end hole, and two diametrically opposed positioning notches formed in said lower side of said vertical wall of said upper cylinder in two horizontal positions angularly symmetrical to those of said positioning holes, each of said top and bottom walls having a central hole formed therethrough;

a generally U-shaped plastic pivot coupler including a vertical plate having a retaining hole formed therethrough, and two generally horizontal plates extending from said vertical plate to clamp said upper and lower cylinders therebetween, each of said horizontal plates including an inner surface, and a pivot post extending from said inner surface, said pivot posts of said horizontal plates respectively extending through said central holes of said top wall of said upper cylinder and said bottom wall of said lower cylinder; and a plastic swivel hook including a curved hanging portion and a generally cylindrical coupling portion connected securely to said hanging portion, said coupling portion having an end surface, an opened slot formed in said end surface defining two easily bendable portions on two sides of said slot, a circumferential surface, and an annular groove formed in said circumferential surface, said vertical plate being sleeved removably on said coupling portion within said annular groove.

2. A packing case as claimed in claim 1, wherein one of said upper and lower housings has a non-pivoted end and a groove formed in said non-pivoted end, the other of said upper and lower housings including a tongue extending therefrom to engage with said groove.

3. A packing case as claimed in claim 1, wherein said upper housing has a first side wall and a second side wall which is opposite to and higher than said first side wall, said lower housing having a third side wall and a fourth side wall which is opposite to and higher than said third side wall, said fourth side wall abutting against said first side wall, said third side wall abutting against said second side wall.

4. A packing case as claimed in claim 1, wherein each of said upper and lower housings has a non-pivoted end, said case body including a nylon thread removably interconnecting said non-pivoted ends of said upper and lower housings.

5. A packing case as claimed in claim 1, wherein one of said upper and lower housings includes a horizontal wall having an inner surface, and a mirror attached to said inner surface of said horizontal wall.

6. A packing case as claimed in claim 1, wherein one of said upper and lower housings includes an upright fastening plate fixed therein, said fastening plate having a retaining slit.

7. A packing case as claimed in claim 1, wherein each of said upper and lower housings has a peripheral surface on which a scale is indicated.

8. A packing case as claimed in claim 1, wherein each of said upper and lower housings has a non-pivoted end surface in which a cylindrical cavity is formed, said case body including a needle having a portion thereof secured in one of said cavities, and a lead rod having a portion which is secured to the other of said cavities

9. A packing case as claimed in claim 1, wherein one of said upper and lower housings has a horizontal wall through which several holes in the shapes of certain geometrical figures are formed.

* * * * *

UNITED STATES PATENT AND TRADEMARK OFFICE

CERTIFICATE OF CORRECTION

PATENT NO. : 4,905,830

DATED : March 6, 1990

INVENTOR(S) : LIN

It is certified that error appears in the above-identified patent and that said Letters Patent is hereby corrected as shown below:

Column 1, line 13, after "cases which" insert --they--.

Column 2, line 35, after "cylinders" delete "11,12,";
line 61, after "122b" insert a period.

Signed and Sealed this

Fourth Day of June, 1991

*Attest:*

HARRY F. MANBECK, JR.

*Attesting Officer*

*Commissioner of Patents and Trademarks*